United States Patent [19]

Scheinpflug

[11] 4,379,645

[45] Apr. 12, 1983

[54] LARGE FORMAT PAPER HANDLING ASSEMBLY FOR TYPEWRITERS OR LIKE BUSINESS MACHINES

[75] Inventor: Gunter Scheinpflug, Nuremberg, Fed. Rep. of Germany

[73] Assignee: Triumph-Adler A.G. für Büro-und Informationstechnik, Nuremberg, Fed. Rep. of Germany

[21] Appl. No.: 313,461

[22] Filed: Oct. 21, 1981

[30] Foreign Application Priority Data

Mar. 5, 1981 [DE] Fed. Rep. of Germany ..... 3108262

[51] Int. Cl.[3] ..... B41J 15/06

[52] U.S. Cl. ..... 400/623; 400/552; 400/634

[58] Field of Search ..... 400/552, 623, 634, 636, 400/26

[56] References Cited

U.S. PATENT DOCUMENTS

| | | | |
|---|---|---|---|
| 1,280,678 | 10/1918 | De Clamecy | 400/552 |
| 1,311,929 | 8/1919 | Tucker | 400/623 |
| 3,767,023 | 10/1973 | Effinger | 400/552 |
| 3,900,098 | 8/1975 | Effinger | 400/552 |
| 4,076,112 | 2/1978 | Effinger | 400/552 |

*Primary Examiner*—Edgar S. Burr
*Assistant Examiner*—David A. Wiecking
*Attorney, Agent, or Firm*—Joseph R. Spalla

[57] ABSTRACT

A large format paper handling assembly has an axially stationary platen which is rotatably mounted on pivotally mounted support arms. The platen is supported on spaced frame supported front guide rollers and rear feed rollers. The off axis rear feed rollers are adapted to be manually and/or automatically line indexed to frictionally feed paper between the rear feed rollers and the platen. Hold down rollers are mounted on a bail extending between spaced paper feed release levers which are pivotally mounted on the frame about the axis of the front guide rollers and are movable away from the platen against the bias of springs. The springs acting through the hold down rollers maintain the platen in frictional engagement with its supporting front guide rollers and rear feed rollers. The pivotal movement of the paper feed release lever withdraws the hold down rollers and also acts to pivot the platen support arms to move the platen away from the front guide rollers and the rear feed rollers. A paper roll of large format paper is peripherally supported on frame mounted rollers and is trained between the platen and the feed rollers and the platen and guide rollers.

2 Claims, 1 Drawing Figure

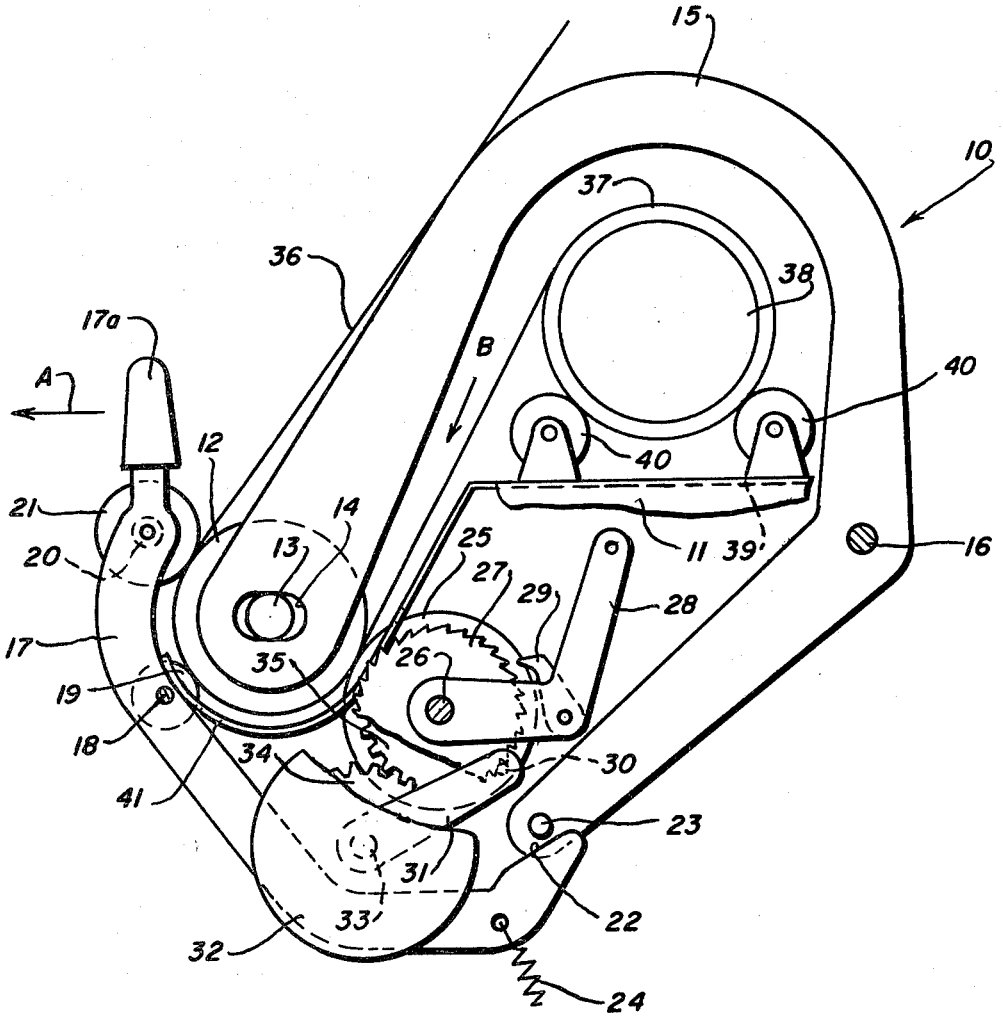
15
10
37
38
36
17a
B
A
40
40
12
14
21
13
25
27
29
28
11
39
16
20
17
35
26
19
18
34
30
41
23
31
22
33
32
24

LARGE FORMAT PAPER HANDLING ASSEMBLY FOR TYPEWRITERS OR LIKE BUSINESS MACHINES

This invention relates to large format paper handling assemblies for typewriters or like business machines; more particularly it relates to a large format paper handling assembly having a platen supported upon front guide rollers and rear feed rollers; and specifically to a large format paper handling assembly in which paper feed release lever means operates to disengage the platen from the guide and feed rollers.

Large format paper handling assemblies known to the are, are represented by U.S. Pat. No. 4,076,112 to Cecil S. Effinger which is an improvement on his earlier U.S. Pat. Nos. 3,767,023 and 3,900,098.

The noted Effinger patents are relatively complex and have certain shortcomings, e.g., no provision is made for both automatic and manual indexing of the platen, nor is provision made for moving the platen to a paper feed release position away from supporting stationary rollers to facilitate paper insertion, lateral paper shifting or paper squaring.

In accordance with the invention the shortcomings of the prior art are accommodated in a paper handling assembly of simple and reliable design. More particularly in accordance with the invention large format paper, for example, in roll form, is supported on a machine frame and guided in turn between frame supported rear feed rollers and a floatingly supported platen, around the platen, between the platen and front guide rollers, and between the platen and upper paper hold down rollers, the latter of which are supported on a bail extending between paper feed release levers. The paper feed release levers are under spring bias and act through the hold down rollers thereon to urge the platen into frictional engagement with the front guide and rear feed rollers. Movement of the paper feed release levers withdraws the hold down rollers and acts against platen support arms to bodily separate the platen from all contacting rollers to a release position to facilitate paper entry, lateral shifting and/or squaring.

An object of the invention is in the provision of a simple and reliable large format paper handling assembly.

Another object of the invention is to provide a large format paper handling assembly which permits automatic as well as freely accessible manual platen indexing.

A further object of the invention is in the provision of a large format paper handling assembly in which the platen may be moved to a paper release position relative to supporting front guide and rear feed rollers without removal of the platen from the assembly.

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

The single FIGURE of the drawing is a side elevational view of a paper handling assembly in accordance with the invention.

Referring now to the drawing there is shown a paper handling assembly generally designated by reference numeral 10 particularly adapted for mounting on the frame 11 of a stationary platen typewriter in which a print element supported on a carriage (not shown) is movable relative to the frame 11 in escapement and carriage return directions.

The paper handling assembly comprises a platen 12 having a central shaft whose ends 13 extend into horizontally elongated holes 14 in spaced platen support arms 15. The elongated holes 14 rotatably support the platen 12 while allowing it to reliably position itself relative to guide and feed rollers. The platen support arms 15 extend upwardly, curve around to the rear and down to frame supported pivots 16 thereby to allow the support arms 15 to be pivoted to enable the platen 12 to be moved to paper release position. To move the platen support arms 15 two paper feed release levers 17 which are pivotably mounted on a shaft 18 fixed in the frame and carrying paper guide rollers 19 are provided. Toward the outer handle ends, the paper feed release levers 17 support a cross bail 20 mounting paper hold down rollers 21. The lower rearwardly directed ends of the paper feed release levers 17 have each a beveled tab 22 which interacts with pins 23 disposed at the lower ends of portions of the platen supporting arms 15 extending beyond and downwardly from pivots 16. Each paper feed release lever 17 is acted upon by a spring 24 to urge the paper hold down rollers 21 towards the platen 12. Disposed on the paper intake side of the platen 12 generally to the rear and below the platen 12 are paper feed or transport rollers 25 of the same diameter as the platen 12 mounted on a cross shaft 26 rotatably supported on the machine frame. The cross shaft 26 has secured thereto a line space ratchet 27 actuable by a conventional line indexing device (not shown) via a suitably spring loaded indexing lever 28 and pawl 29. A detent 30 also supported by a suitably spring-loaded lever 31, is provided to detentably hold the line space ratchet 27.

To turn the platen 12 a platen turning knob 32 is mounted on a shaft 33 rotatably supported in the frame generally below and rearwardly of the platen 12. A manually performed rotary motion of the knob 32 is transmitted to the platen 12 via a gear 34 fixed to the shaft 33 of the turning knob 32 and another gear 35 fixed to the shaft 26 of the paper transport rollers 25 adapted to frictionally drive the platen 12.

The wide format paper 36 to be written on, such as paper used for technical drawings, e.g., in the form of a paper roll 37 on a core 38, is mounted on rollers 40 carried on a stationary support 39 secured to the machine frame. The support 39 extends downwardly towards and around the platen 12 to form a paper trough 41 provided with openings to accomodate the feed and guide rollers 25 and 19.

The operation of the device is as follows:

To feed the paper 36 of any width unwound from the paper roll 37 and to be typewritten on, the paper feed release levers 17 are actuated in the direction of arrow A to a release position and suitably held, thereby carrying the paper hold down rollers 21 off and away from the platen 12. At the same time the beveled tab 22 at the lower ends of the paper feed release levers 17 act to pivot the platen supporting lever arms 15 about pivots 16 via the pins 23, whereby the platen 12 is raised relative to the guide rollers 19 and the feed rollers 25 thereby to open the gap between platen 12 and the paper trough 41 wider. The wider gap between the platen 12 and the paper trough 41 can now facilitate leading the paper 36 around the platen 12 in the direction of arrow B to bring the lead edge beyond the hold down rollers 21 and to square the paper 36. After this is done, the paper feed release levers 17 are returned to their basic position by and are maintained, positioned by the springs 24. The return of the paper release levers 17 from feed release positions allows the supporting arms 15 to return to the basic position shown and the platen 12 to locate itself via slot 14 upon the paper supporting guide rollers 19 and the transport rollers 25. As the platen shaft 13 is mounted in an elongated hole 14, the platen 12 can so place itself on the rollers 19 and 25, respectively, that the paper 36 is securely guided and reliably transported in case of a line shift by means of the pawl 29. The mass of platen 12 is adequate to obtain a safe bearing pressure against the rolls 19 and 25.

The platen turning knob 32 which, as described above, transmits its rotary motion to the platen 12 via the gears 34 and 35 can be operated manually to adjust the paper 36 to the line to be written on.

According to the invention since the platen turning knob 32 is below the platen it remains accessible from the side so that a rotary adjustment of the platen 12 can be made without hindrance by side edges of paper 36 projecting to the left and right beyond the sides of the typewriter. Moreover, since the support 39 carrying paper in roll form is stationary and only the type carrier moves, crumpling of paper side edges hitting objects on the desk is obviated. Further, the pivoting of the paper feed release levers 17 to paper release position facilitates, in a simple manner, paper insertion squaring and/or lateral shifting so that a new portion of its width is positioned in front of the platen within the writing line of the print element which can then be typed on.

The invention claimed is:

1. A large format paper handling assembly for association with a printing element movable in escapement and carriage return directions comprising a frame, platen support arms pivotably mounted on said frame, a platen having its ends rotatably and translatably mounted between said support arms, frame mounted guide rollers and rearwardly spaced feed rollers for rotatably supporting said platen, paper feed release lever means pivotably mounted on the axis of said guide rollers, paper hold down rollers supported on said paper feed release lever means for engaging said platen, and means on said paper feed release lever means for rocking said support arms incident to movement of said paper feed release lever means to a release position to move said platen support arms and said platen from engagement with said guide and feed rollers.

2. An assembly as recited in claim 1, including a platen turning means rotatably supported on said frame, and gear means on said turning means and said feed rollers for transmitting turning motion to frictionally drive said platen.

* * * * *